US005383578A

United States Patent [19]

Nishimura

[11] Patent Number: 5,383,578

[45] Date of Patent: Jan. 24, 1995

[54] PARTICLE CARRYING DEVICE FOR CARRYING WASTE PARTICLES TO A WASTE PARTICLE RECEPTACLE

[75] Inventor: Soichiro Nishimura, Nagoya, Japan

[73] Assignee: Brother Kogyo Kabushiki Kaisha, Nagoya, Japan

[21] Appl. No.: 25,772

[22] Filed: Mar. 3, 1993

[30] Foreign Application Priority Data

May 20, 1992 [JP] Japan ..... 4-127719

[51] Int. Cl.[6] ..... B67D 1/16; G03g 21/00

[52] U.S. Cl. ..... 222/108; 355/298; 222/DIG. 1

[58] Field of Search ..... 355/298, 260, 245; 222/DIG. 1, 325, 413, 162, 438; 141/357, 354, 353, 352, 351; 229/125.42, 217

[56] References Cited

U.S. PATENT DOCUMENTS

| | | | |
|---|---|---|---|
| 3,831,833 | 8/1974 | Dressler et al. | 229/125.42 |
| 4,144,989 | 3/1979 | Joy | 222/438 |
| 4,168,003 | 9/1979 | Wysocki | 229/217 |
| 4,627,716 | 12/1986 | Oka | 355/298 |
| 4,630,653 | 12/1986 | Kan | 355/298 X |
| 4,849,791 | 7/1989 | Hagihara et al. | 355/298 |
| 4,860,056 | 8/1989 | Kano et al. | 355/298 |
| 4,862,226 | 8/1989 | Imaizumi et al. | 222/DIG. 1 X |
| 4,941,022 | 7/1990 | Ohmura et al. | 222/DIG. 1 X |
| 4,982,231 | 1/1991 | Matsuuchi | 355/298 X |
| 5,002,208 | 3/1991 | Towery | 222/438 |
| 5,128,724 | 7/1992 | Hayashi et al. | 355/298 |
| 5,130,756 | 7/1992 | Taniyama | 222/413 X |
| 5,132,740 | 7/1992 | Okamoto et al. | 355/298 |
| 5,200,787 | 4/1993 | Nishiguchi | 355/298 |
| 5,261,568 | 11/1993 | Corby et al. | 222/DIG. 1 X |

FOREIGN PATENT DOCUMENTS

| | | | |
|---|---|---|---|
| 61-114270 | 5/1986 | Japan | 355/298 |
| 63-10424 | 2/1987 | Japan . | |
| 1-191886 | 8/1989 | Japan | 355/298 |
| 1-314279 | 12/1989 | Japan | 355/298 |
| 2-134669 | 5/1990 | Japan | 355/298 |
| 2-222984 | 9/1990 | Japan | 355/298 |
| 3-179385 | 8/1991 | Japan | 355/298 |
| 5-094121 | 4/1993 | Japan | 355/298 |

*Primary Examiner*—Matthew S. Smith
*Assistant Examiner*—Shuk Y. Lee
*Attorney, Agent, or Firm*—Oliff & Berridge

[57] ABSTRACT

The present invention relates a particle carrying device wherein a carrying passage can be detachably installed onto a toner particle collection unit for storing wasted particles, without dropping the particles. According to the particle carrying device, when the carrying passage is attached onto a particle container, a shutter provided on the carrying passage is moved. Then, a guide member stored in the carrying passage is moved and an opening provided in the carrying passage is opened. Noteover, as a carrying auger rotatably supported in the carrying passage rotates, the waste particles are carried toward the particle container through the opening. On the other hand, when the carrying passage is detached from the particle container, the guide member is moved back into the carrying pipe, and the opening is shut. Further, the shutter moves so as to shield the opening and maintain the guide member in the closed position, so that the particles are prevented from dropping out of the opening.

19 Claims, 4 Drawing Sheets

PARTICLE CARRYING DEVICE FOR CARRYING WASTE PARTICLES TO A WASTE PARTICLE RECEPTACLE

BACKGROUND OF THE INVENTION

1. Field of the Invention

The present invention relates to a particle carrying device for carrying particles used in an electrophotographic device or the like toward a predetermined direction, and more particularly to a particle carrying device which can be detachably installed onto a particle collection unit without dropping particles.

2. Description of Related Art

Conventionally, an electrophotographic device include a particle carrying device for collecting and carrying toner particles used in the electrophotographic device toward a wasted toner particle container. As the particle carrying device mentioned above, for example, a particle carrying device is disclosed in Japanese Patent Publication No. 63-10424.

First, the structure of the particle carrying device will be explained with reference to FIGS. 2–5. FIG. 2 is a schematic structure view of a general electrophotographic device 50. The electrophotographic device 50 comprises a photosensitive drum 52, around which a charging device 54, an exposing device 56, a developing device 58, a transferring device 60 and a cleaner 62 are provided.

The photosensitive drum 52 comprises a conductive drum body which is grounded and a photoconductivity layer which is provided on the conductive drum body. The photosensitive drum 52 rotates in the direction indicated by an arrow A as shown in FIG. 2. The charging device 54, the exposing device 56, the developing device 58, the transferring device 60 and the cleaner 62 are in order arranged according to the rotational direction of the photosensitive drum 52.

The charging device 54 is a well-known corotron. The exposing device 56 comprises a laser beam emitter and a polygonal mirror which are known well.

The developing device 58 comprises a hopper 64A, a rotational body 64B, a wasted toner particle container 64C and a brush roller blade 64D. The hopper 64A stores unused toner particles therein. The toner particles are made of a one-component developer comprising magnetic toner particles or are made of a two-component developer comprising toner particles and magnetic carriers. Moreover, the hopper 64A has an opening on the lower portion thereof. The rotational body 64B rotates in the direction of arrow B, as shown in FIG. 2. A part of the rotational body 64B sticks out of the hopper 64A through the opening. The rotational body 64B comprises a sleeve which is a nonmagnetic body and a magnetic roller which is disposed rotatably inside of the sleeve. The sleeve and the magnetic roller can rotate relatively each other. Moreover, the rotational body 64B is disposed opposite to the photosensitive drum 52 and spaced therefrom at a predetermined interval. The wasted toner particle container 64C stores wasted toner particles which are discharged from the cleaner 62 (to be described later). The brush roller blade 64D is fixed to the outside wall of the hopper 64A. One end of the brush roller blade 64D is positioned close to the surface of the rotational body 64B. The amount of toner particles on the rotational body 64B are controlled with the brush roller blade 64D. The developing device 58 having the above-mentioned structure is detachably installed in the main body of the electrophotographic device 50 as a single unit.

The transferring device 60 is a well-known corotron.

The cleaner 62 is used for removing the toner particles remaining on the photosensitive drum 52. The cleaner 62 comprises a case 62A and a cleaning blade 62B. A screw 70 for carrying the wasted toner particles is provided in the case 62A. The cleaning blade 62B is made of urethane rubber, and comes in contact with the surface of the photosensitive drum 52. If less than all toner particles are transferred onto a paper by the transferring device 60, the untransferred toner particles remain on the surface of the photosensitive drum 52. The remaining toner particles are removed from the surface of the photosensitive drum 52 by the cleaning blade 62B. Alternatively, a fur brush may be used instead of the urethane rubber cleaning blade 62B.

Next, the operation of the electrophotographic device 50 will be explained.

In the electrophotographic device 50, the charging device 54 evenly distributes a charge having a predetermined polarity onto the surface of the photosensitive drum 52. Next, the exposing device 56 irradiates the photosensitive drum 52 with the laser beam based on an image data. Accordingly, an electrostatic latent image of the image is formed on the surface of the photosensitive drum 52. The electrostatic latent image is developed to a visible image with the toner particles by the developing device 58, so that a toner particle image is formed on the surface of the photosensitive drum 52. Further, the toner particle image is transferred onto a paper 66 by the transferring device 60. At this time, if less than all toner particles are transferred onto the paper 66 by the transferring device 60, some toner particles remain on the surface of the photosensitive drum 52. However, the remaining toner particles are collected from the surface of the photosensitive drum 52 by the cleaner 62. After the remaining toner particles are removed from the surface of the photosensitive drum 52, the photosensitive drum 52 is charged again with the predetermined polarity by the charging device 54. After this, the above-mentioned process is repeated.

In the electrophotographic device 50 having the above-mentioned structure, the wasted toner particle carrying device comprises the cleaner 62 and a carrying pipe 68. The cleaner 62 and the wasted toner particle container 64C are connected each other through the carrying pipe 68. As shown in FIG. 5, the head portion 77 of the carrying pipe 68 is detachable from the wasted toner particle container 64C. The wasted toner particles collected by the cleaner 62 are carried into the carrying pipe 68 by the screw 70 disposed in the cleaner 62, and are stored in the wasted toner particle container 64C.

Next, the structure and the operation of the connecting portion between the head portion 77 of the carrying pipe 68 and the wasted toner particle container 64C will be explained in detail with reference to FIGS. 3–5.

As described above, the developing device 58 is detachably installed in the main body. Therefore, the head portion 77 of the carrying pipe 68 is detachable from the wasted toner particle container 64C. When the head portion 77 of the carrying pipe 68 is detached from the wasted toner particle container 64C, the wasted toner particles may drop out of the openings of the carrying pipe 68 and the wasted toner particle container 64C. Therefore, there is a need to provide means for preventing the toner particles from dropping out of either opening. FIG. 4A is a cross-sectional view of the head portion of the carrying pipe 68 from the cleaner 62. FIG. 4B is a partial cross-sectional view of the wasted toner particle container 64C. FIG. 5 is a view showing the connecting portion between the head portion 77 of the carrying pipe 68 and the wasted toner particle container 64C.

As shown in FIG. 4B, when the head portion 77 of the carrying pipe 68 is not connected to the wasted toner particle container 64C, an opening 72 of the wasted toner particle container 64C is covered with a lid 74. Since the lid 74 is supported pivotably centering on a shaft 76, the lid 74 can open and shut the opening 72. The head portion 77 of the carrying pipe 68 is formed so as to be pointed (i.e., having an abbreviated tapered shape). The pointed head of the carrying pipe 68 has an opening 77A. And, in the head portion 77, a valve 78 is resiliently urged by a spring 80 at all times to shut the opening 77A. When the head portion 77 of the carrying pipe 68 is connected to the wasted toner particle container 64C, a stick member (not shown) pivots the lid 74 so as to open the opening 72. And, as the head portion 77 of the carrying pipe 68 is inserted into the opening 72, a pin 82 disposed in the wasted toner particle container 64C pushes the valve 78 against the spring 80. Accordingly, the opening 77A of the pointed head of the carrying pipe 68 is opened. Thus, the carrying pipe 68 is installed completely into the opening 72 of the wasted toner particle container 64C.

However, in the above-mentioned wasted toner particle carrying device, there are the following problems. Since the toner particles collected by the cleaner 62 are carried to the wasted toner particle container 64C through the carrying pipe 68, the wasted toner particles are present in the head portion 77 of the carrying pipe 68 at all times. Further, when the carrying pipe 68 is removed from the wasted toner particle container 64C, the valve 78 returns to the former state by expansion of the spring 80. Then, according to the operation of the spring 80, the wasted toner particles which are present in the head portion 77 are pushed out of the opening 77A of the carrying pipe 68 by the valve 78. Therefore, the surroundings of the connection portion between the head portion 77 of the carrying pipe 68 and the wasted toner particle container 64C are stained with the toner particles.

SUMMARY OF THE INVENTION

It is therefore an object of the present invention to provide a particle carrying device which can be detachably installed onto a particle collection unit without dropping the toner particles.

To achieve the above-mentioned object, a preferred embodiment of the particle carrying device of the present invention which can be detachably installed onto a storing device for storing wasted particles, and can carry the particles into the storing device, comprises a hollow carrying passage which can be connected to the storing device and can carry the particles, an opening formed in a part of the carrying passage, a guide member which rotate between a shutting position to shut the opening, by being stored in the carrying passage and an opening position to open the opening by being drawn from the carrying passage and a shielding member movable between a first position shielding the opening while the guide member is stored in the carrying passage and a second position exposing the opening while allowing the guide member to move out of the carrying passage.

According to the present invention having above-mentioned structure, the particles carried into the hollow carrying passage are not dropped out of the carrying passage when the shielding member positions at the first position, because the opening formed on a part of the carrying passage is covered with the guide member and the shielding member. Moreover, when the shielding member is moved to the second position and the guide member moves to the open position, the carried particles are discharged from the carrying passage through the opening formed on the carrying passage.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Figure 1A:
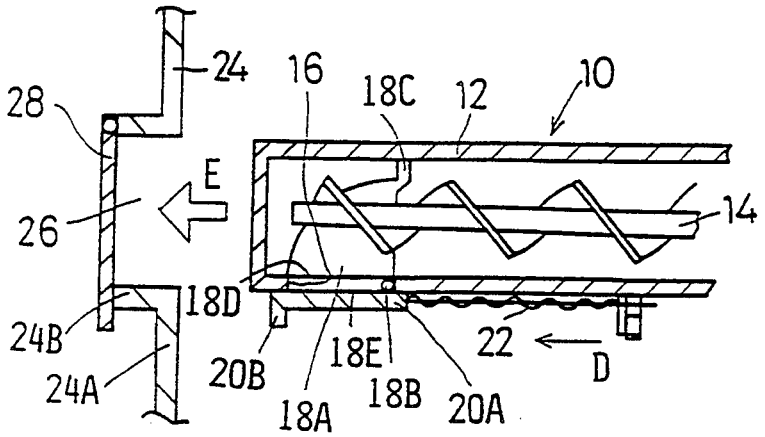
FIG. 1A is a cross-sectional view showing the condition that a carrying pipe of a particle carrying device of the present invention is apart from a wasted toner particle container.

Hereinafter, a preferred embodiment which embodies the present invention will be explained with reference to the figures.

In the Related Art, the connecting portion where a head portion 77 of a carrying pipe 68 and a wasted toner particle container 64C are connected each other is explained. However, the connecting portion of a wasted toner particle carrying device which is a particle carrying device of the present invention, is different from that of the conventional wasted toner particle carrying device. In other words, the wasted toner particle carrying device of the present embodiment has the same structure as the conventional wasted toner particle carrying device except for the connecting portion. Therefore, in the wasted toner particle carrying device of the present embodiment, the same structural elements as the conventional wasted toner particle carrying device described in the Related Art are shown by same reference numerals used in the Related Art.

The head portion of a carrying pipe 12 which functions as a carrying passage of a wasted toner particle carrying device 10 of the present embodiment comprises an opening 16, a guide member 18, a shutter 20A as a shielding member and a spring 22 as an urging member. The carrying pipe 12 is a hollow, in which a carrying auger 14 as a carrying member is provided. The carrying auger 14 rotates by a driving source (not shown), and carries wasted toner particles collected by a cleaner 62 toward the opening 16.

The opening 16 is formed on the bottom side of the head portion of the carrying pipe 12. The wasted toner particles which are carried through the carrying pipe 12 are discharged from the opening 16.

Figure 1B:
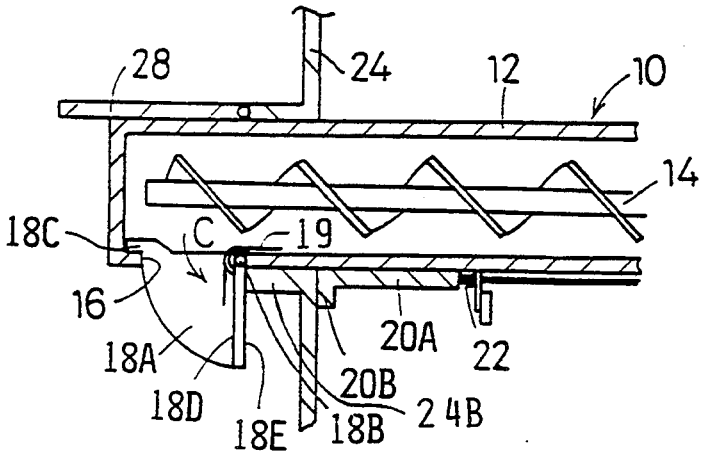
FIG. 1B is a cross-sectional view showing the condition that the carrying pipe of the particle carrying device of the present invention is connected to the wasted toner particle container.
Figure 1C:
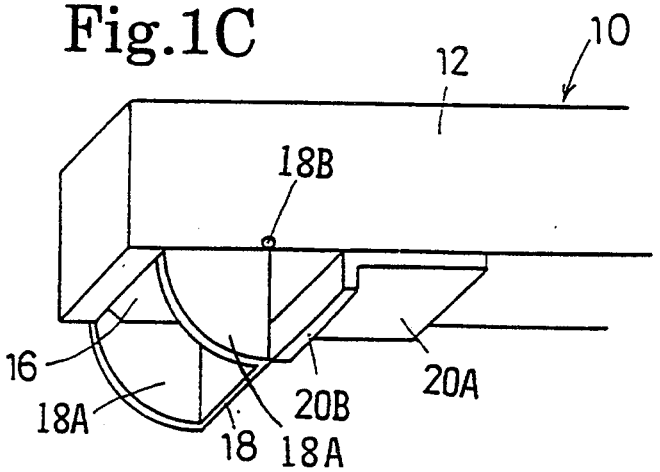
FIG. 1C is a lower angle perspective view showing the condition that the opening of the carrying pipe of the particle carrying device of the present invention is opened.
Figure 2:
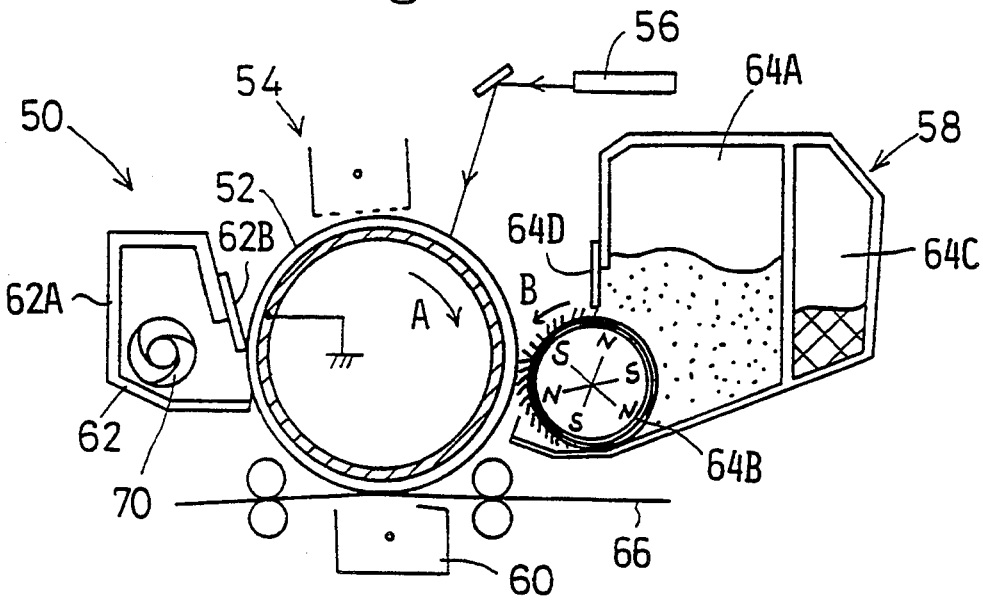
FIG. 2 is a schematic structure view of an electrophotographic device.
Figure 3:
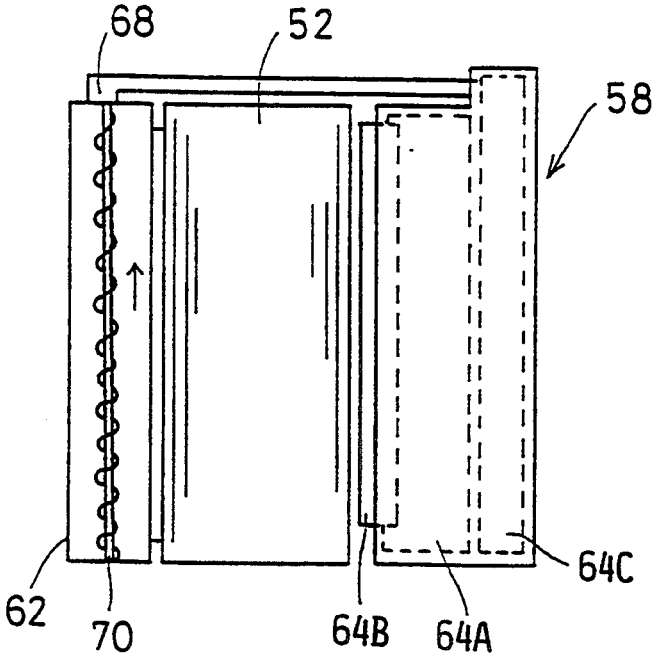
FIG. 3 is an upper surface view of the electrophotographic device shown in FIG. 2.
Figure 4A:
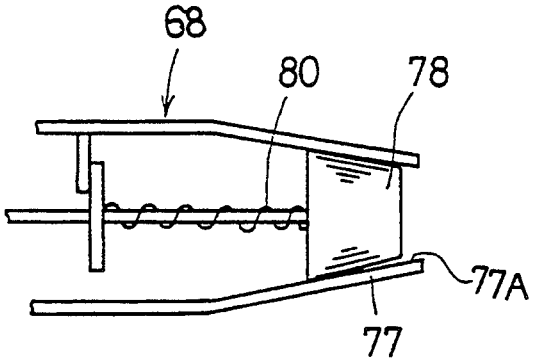
Fig.4A RELATED ART
FIG. 4A is a cross-sectional view showing the head portion of a carrying pipe of the conventional particle carrying device.
Figure 4B:
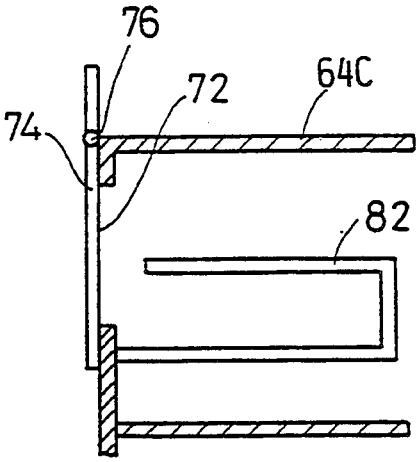
Fig.4B RELATED ART
FIG. 4B is a cross-sectional view showing the opening of the conventional wasted toner particle container.
Figure 5:
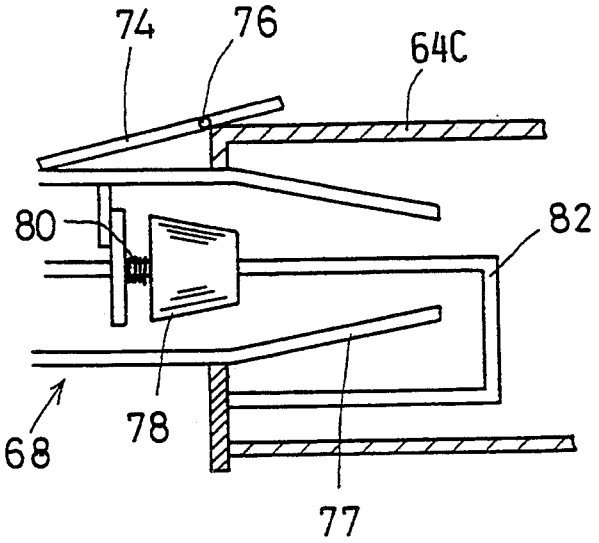
Fig.5 RELATED ART
FIG. 5 is a cross-sectional view showing the condition that the carrying pipe of the conventional particle carrying device is connected to the conventional wasted toner particle container.

The guide member 18 comprises two sides 18A, a stop claw 18C and a lid 18D. The opening 16 is opened or shut by moving the guide member 18 between a shutting position and an opening position. The guide member 18 is pivotably supported on a shaft 18B. While the guide member 18 can rotate between the shutting position and the opening position, the guide member 18 is biased towards the opening position by a torsion spring 19. As shown in FIG. 1A, when the guide member 18 is in the shutting position, the opening 16 is shut by the lid 18D. On the other hand, as shown in FIGS. 1B–1C, when the guide member 18 is in the opening position, the lid 18D moves away from the opening 16, to a position where the stop claw 18C contacts the carrying pipe 12. Moreover, the guide member 18 is resiliently urged by the torsion spring 19 at all times in the direction indicated by C arrow of FIG. 1B.

The shutter 20 comprises a main plate 20A and a projecting portion 20B. The shutter 20 is provided slidably along the outside wall of the carrying pipe 12. The shutter 20 is resiliently urged by the spring 22 at all times in the direction indicated by D arrow shown in FIG. 1A. And, as shown in FIG. 1A, the shutter 20 is usually in a first position such that the guide member 18 is in the shutting position. Moreover, when the shutter 20 is moved by force to a second position, as shown in FIG. 1B, against the spring 22, the guide member 18 is moved from the shutting position to the opening position by the torsion spring. Accordingly, the opening 16 is opened. That is, as shown in FIG. 1A, the guide member 18 is usually in the shutting position and the shutter 20 is usually in the first position. However, when the carrying pipe 12 is inserted through a wall 24 of the wasted toner particle container, as shown in FIG. 1B, the guide member 18 and the shutter 20 are moved to the opening position and the second position, respectively.

One end of the spring 22 is fixed by a stop member and the other end of the spring 22 is fixed to the main plate 20A of the shutter 20. Therefore, as mentioned above, the shutter 20 is resiliently urged by the spring 22 at all times toward the direction indicated by arrow D shown in FIG. 1A.

On the other hand, a store opening 26 and an opening-shutting cover 28 are provided on the wall 24 of the wasted toner particle container 64C as a particle storing device. The opening-shutting cover 28 opens or shuts the store opening 26, and is biased towards the shut position to shut the store opening 26 by a torsion spring (not shown). Moreover, the sectional shape of the store opening 26 is almost same as that of the carrying pipe 12. Further, since the carrying pipe 12 is inserted through the store opening 26 in order to carry the toner particles into the wasted toner particle container 64C, the store opening 26 is structured to avoid dropping the toner particles. When the carrying pipe 12 is inserted through the store opening 26, the side wall 24A comes in contact with the projecting portion 20B of the shutter 20. Therefore, as shown in FIG. 1B, the shutter 20 is moved from the first position to the second position.

The carrying pipe 12, the carrying auger 14, the guide member 18 and the shutter 20 are made of thermoplastic resin such as ABS (acrylonitrile-butadien-styrene resin), polyacetal resin, MPPO (denatured polyphenyl oxide), POM (polyacetal resin) or the like. Further, those members needing high strength, such as the carrying auger 14, may be made by the above-mentioned resin material mixed with glass fiber.

Next, the operation of the wasted toner particle carrying device 10 of the present embodiment will be explained with reference to FIGS. 1A–1C.

First, an operator inserts the head portion of the carrying pipe 12 of the wasted toner particle carrying device 10 into the store opening 26 formed on the wall 24 in the direction indicated by E arrow of FIG. 1A. Then, the opening-shutting cover 28, which is usually biased towards the shut position by the torsion spring (not shown) is pressed open by the head of the carrying pipe 12. As shown in FIG. 1B, the store opening 26 is thereby opened.

Then, only after the head portion of the carrying pipe 12, including the opening 16, has been inserted into the store opening 26A, does the projecting portion 20B of the shutter 20 come in contact with the side wall 24A of the wasted toner particle container. Therefore, as the carrying pipe 12 is inserted into the store opening 26, the shutter 20 is moved by force from the first position to the second position. As described above, the guide member 18 is resiliently urged by the spring at all times toward the direction indicated by C arrow of FIG. 1B. Therefore, when the shutter 20 moves to the second position, the guide member 18 is pivoted toward the direction indicated by C arrow centering on the shaft 18B from the shutting position. The guide member 18 pivots until the stop claw 18C bumps against the inside bottom wall of the carrying pipe 12, so that the guide member 18 is positioned at the opening position. Accordingly, the opening 16 is opened. Then, an internal space of the carrying pipe 12 is connected to an internal space of the wasted toner particle container. In this condition, the wasted toner particles are carried toward the wasted toner particle container passing though the carrying pipe 12, the opening 16 and the guide member 18 as the carrying auger 14 rotates. At this time, the wasted toner particles adhere to the inside surface of the lid 18D, but do not adhere to the outside surface 18E of the lid 18D.

Besides, when the wasted toner particle carrying device 10 is removed from the wasted toner particle container, the above-mentioned operation is reserved. That is, the carrying pipe 12 is pulled out in the reverse of the direction indicated by E arrow of FIG. 1A. At this time, a supporter 24B of the side wall 24A of the wasted toner particle container urges the lid 18D of the guide member 18 such that the lid 18D pivots in the reverse of the direction indicated by C arrow. Therefore, the guide member 18 is gradually moved from the opening position to the shutting position as the pipe 12 is pulled out. Moreover, the shutter 20A is resiliently urged by the spring 22 at all times toward the direction indicated by arrow D. Therefore, as the guide member 18 is removed, the shutter 20A is gradually returned to the first position. That is, when the guide member 18 is returned to the shutting position, the shutter 20A is returned to the first position, too. On the other hand, the store opening 26 is covered with the opening-shutting lid 28. Thus, the carrying pipe 12 of the wasted toner particle carrying device 10 is completely detached from the wasted toner particle container.

As described above, the toner particles do not adhere to the outside 18E of the guide member 18. Therefore, when the carrying pipe 12 is removed from the wasted toner particle container, the toner particles are prevented from dropping out of the crack of the shutter 20A. According to the present invention, if the operator inserts the carrying pipe 12 into the store opening 26, the internal space of the carrying pipe 12 and the internal space of the wasted toner particle container are connected each other. Therefore, it is easy for the operator to deal with the wasted toner particle carrying device 10.

As is apparent from the above explanation, according to the particle carrying device of the present invention, the collected particles are discharged by the guide member with certainty. Moreover, when the particles are not to be discharged from the carrying passage, the opening is covered with the guide member and the shutter. Therefore, the particles are prevented from dropping out of the opening.

This invention is not limited to the above mentioned embodiment. It should be understood that many changes and modifications may be made in the embodiment without departing from the scope of the present invention.

For instance, it is not necessarily to provide the carrying auger.

What is claimed is:

1. A particle carrying device, detachably installable into a storing device for storing waste particles, for delivering the particles to the storing device, comprising:

a carrying portion having a particle delivery passage and detachably insertable into the storing device;

an opening formed in a head portion of the carrying portion and connecting the particle delivery passage with a surrounding environment;

a guide member pivotably attached to the head portion and reciprocatably movable between a closed position covering the opening and an open position uncovering the opening; and a shielding member supported independently from said guide member on the head portion and movable between a first position for maintaining the guide member in the closed position and a second position for allowing the guide member to pivot between the open and closed positions.

2. The particle carrying device of claim 1, wherein the shielding member further comprises a biasing member for biasing the shielding member into the first position.

3. The particle carrying device of claim 1, wherein the guide member further comprises a biasing member for biasing the guide member from the closed position to the open position.

4. The particle carrying device of claim 1, wherein the guide member further comprises a pair of sides attached to a lid, the lid being rotatably pinned to the particle carrying device, the sides and lid extending into the particle carrying device when the guide member is in the closed position and a catch capable of contacting an inside surface of the particle carrying device so as to prevent the guide member from rotating from the closed position to a point past the open position.

5. A particle carrying device detachably insertable into a storing device for storing wasted particles, and able to deliver the particles into the storing device, comprising:

a hollow carrying passage detachably insertable into the storing device and able to carry the particles;

an opening formed on a part of the carrying passage;

a guide member pivotably attached to one side of the opening and pivotable between a shutting position so as to shut the opening by being stored in the carrying passage, and an opening position so as to open the opening by being withdrawn from the carrying passage; and a shielding member, movable independently from the guide member and reciprocatably positionable between a first position shielding the opening by maintaining the guide member in the carrying passage, and a second position exposing the opening to permit the guide member to be withdrawn from the carrying passage.

6. The particle carrying device of claim 5, wherein said storing device has a wall, the wall having a connecting opening, the hollow carrying passage insertable through the connecting opening.

7. The particle carrying device of claim 6, wherein a shape of the connecting opening is substantially identical to a sectional shape of the hollow carrying passage.

8. The particle carrying device of claim 6, further comprising a first biasing member, wherein said shielding member is biased towards the first position by said biasing first member.

9. The particle carrying device of claim 8, wherein said shielding member comprises a main plate and a projecting portion projecting from the main plate wherein when the hollow carrying passage is inserted through the connecting opening of the storing device, said shielding member is moved from the first position to the second position by said projecting portion contacting the wall of the storing device, and said guide member is biased to the opening position by a second biasing member to expose said opening of said hollow carrying passage.

10. The particle carrying device of claim 9, wherein when the carrying passage is removed from the connecting opening, said shielding member is moved from the second position to the first position by the first biasing member, and said guide member is moved to the closing position to close said opening of said carrying passage.

11. The particle carrying device of claim 6, wherein said storing device has an opening-shutting cover for opening and shutting the opening of said storing device, said cover shutting the opening of said storing device when said carrying passage is removed from the opening of said storing device, said cover opening the opening of said storing device when said carrying passage is inserted through the opening of said storing device.

12. The particle carrying device of claim 6, wherein the wall of said storing device has a supporting portion, said guide member being forced into the carrying passage by said supporting portion when the carrying passage is removed from the storing device.

13. The particle carrying device of claim 5, further comprising a particle carrying member provided in the hollow carrying passage, said carrying member carrying the particles in the carrying passage towards the opening.

14. A particle carrying device detachably insertable into a storing device for storing wasted particles, and able to deliver the particles into the storing device, comprising:

a hollow carrying passage detachably insertable into the storing device and able to carry the particles;

an opening formed on a part of the carrying passage;

a guide member positionable between a shutting position so as to shut the opening by being stored in the carrying passage, and an opening position so as to open the opening by being withdrawn from the carrying passage; and a shielding member sequentially movable with respect to the guide member and reciprocatably positionable between a first position shielding the opening by maintaining the guide member in the carrying passage, and a second position exposing the opening to permit the guide member to be withdrawn from the carrying passage.

15. The particle carrying device of claim 1, wherein said shielding member in said first position interferes with the opening of the guide member to said open position.

16. The particle carrying device of claim 5, wherein said shielding member in said first position makes contact with and prevents the guide member from opening to said opening position.

17. The particle carrying device of claim 14, wherein said shielding member prevents the opening of said guide member to said opening position.

18. The particle carrying device of claim 17, wherein said shielding member is movable to said second position before the guide member moves to said opening position.

19. The particle carrying device of claim 9, wherein the wall of said storing device has a supporting portion, said guide member being forced into the carrying passage by said supporting portion when the carrying passage is removed from the storing device.

* * * * *